US011806608B2

(12) United States Patent
Brown

(10) Patent No.: US 11,806,608 B2
(45) Date of Patent: Nov. 7, 2023

(54) OVERLAY FOR COLLECTIBLE TRADING CARDS

(71) Applicant: Chad Brown, Madison, WI (US)

(72) Inventor: Chad Brown, Madison, WI (US)

( * ) Notice: Subject to any disclaimer, the term of this patent is extended or adjusted under 35 U.S.C. 154(b) by 284 days.

(21) Appl. No.: 17/365,345

(22) Filed: Jul. 1, 2021

(65) Prior Publication Data

US 2021/0322861 A1 Oct. 21, 2021

Related U.S. Application Data

(63) Continuation-in-part of application No. 16/661,555, filed on Oct. 23, 2019, now Pat. No. 11,065,530.

(51) Int. Cl.

| | |
|---|---|
| ***A63F 1/06*** | (2006.01) |
| ***A63F 1/02*** | (2006.01) |
| ***G09F 1/10*** | (2006.01) |
| ***A63F 11/00*** | (2006.01) |

(52) U.S. Cl.

CPC ..... *A63F 1/06* (2013.01); *A63F 1/02* (2013.01); *A63F 11/0074* (2013.01); *G09F 1/10* (2013.01); *A63F 2011/0086* (2013.01)

(58) Field of Classification Search

CPC ..... A63F 1/06; A63F 1/10; A63F 1/02; A63F 11/0074; A63F 2009/062; G09F 1/10

See application file for complete search history.

(56) References Cited

U.S. PATENT DOCUMENTS

| | | | | |
|---|---|---|---|---|
| 5,201,525 | A * | 4/1993 | Castro | A63F 1/02 273/303 |
| 9,616,323 | B2 * | 4/2017 | Gilson | A63F 1/00 |
| 2007/0022647 | A1 * | 2/2007 | Miller | B32B 27/08 40/654.01 |
| 2010/0146829 | A1 * | 6/2010 | Haneda | A63F 1/02 40/124.191 |
| 2011/0056101 | A1 * | 3/2011 | Basso | A63F 9/0613 40/124.191 |
| 2012/0001390 | A1 * | 1/2012 | McAndrew | A63F 1/02 273/288 |

* cited by examiner

*Primary Examiner* — Michael D Dennis

(74) *Attorney, Agent, or Firm* — Wozny IP Law; Thomas M. Wozny

(57) ABSTRACT

An overlay having artwork printed thereon in a strategic location such that when placed over the front face of a card changes the look and appearance of the original artwork on the front face of the card. In some embodiments, the overlay changes the original text printed on the card (1) to provide a translation of that text into any desired language, or (2) to provide updated rule changes from the rules originally printed on the card, or (3) to provide both a translation as well as updated rule changes, if desired. The overlay may be used with any type of card, but is preferably used with playing cards and trading cards, and is most preferably used with collectible trading cards.

16 Claims, 8 Drawing Sheets

Generic playing card

Generic playing card

Alter Sleeve protective covering with aesthetic design

Aesthetically different card due to protective covering protective covering with aesthetic design Aesthetically different card due to protective covering

OVERLAY FOR COLLECTIBLE TRADING CARDS

BACKGROUND OF THE INVENTION

The present invention relates to cards such as playing cards and trading cards, and more specifically to an overlay for a card, preferably for a playing card or trading card. In one embodiment, the overlay changes the look and appearance of the card but not its function. In another embodiment, the overlay changes the original text printed on the card (1) to provide a translation of that text into any desired language, or (2) to provide updated rule changes from the original rules printed on the card, or (3) to provide both a translation as well as updated rule changes, if desired.

A conventional deck of playing cards includes fifty two individual cards each measuring about 3.5 inches by 2.5 inches. Such cards are typically composed of thin cardboard or pasteboard stock having a generic geometric pattern printed on their back faces, and pictorial, graphics and text on their front faces representative of their value when playing card games such as poker, bridge, euchre, hearts, sheepshead, Uno and other recreational card games.

Trading cards are also well known. Various forms of trading cards have been popular over the years, especially sports trading cards relating to baseball, football, basketball and hockey. Such a card typically has a photograph or likeness of a sports figure on its front face, and statistical information about the pictured sports figure on its back face. Although such cards are referred to as "trading" cards, they are today more frequently referred to as "collectible" cards or simply "collectibles."

A hybrid type of card is one that is used in what is commonly referred to as a collectible card game. A collectible card game is a strategy card game that utilizes specially designed sets of cards having proprietary artwork or designs on one face to embellish the card. The artwork may depict fantasy or science fiction genres, horror themes, cartoons, aliens, and the like. Each card also usually has text printed thereon describing the function of a card and/or the rules for playing a card which are used to strategically interact with other cards during play. Successful collectible card games typically have thousands of unique cards, and as one example, the game "Magic: The Gathering" has over 17,000 distinct cards.

When playing a collectible card game, players acquire cards and organize them into a personal collection from which they create customized decks of cards and challenge other players in matches and tournaments. However, cards that are worn are considered to be marked, and therefore cannot be used, especially in tournament decks. As a result, plastic card sleeves are used to protect game cards from wear and tear. A card sleeve, sometimes also referred to as a card protector, is a card-sized envelope or outer sheath of clear plastic, such as polypropylene, having a front panel attached at its periphery to a rear panel with its top end open, referred to as a top-loading card sleeve, its bottom end open, referred to as a bottom-loading card sleeve, or one of its sides open, referred to as a side-loading card sleeve, forming a slot so that a player may slide or insert a card therein. Card sleeves are specifically dimensioned to snugly hold and protect a game card. Although some card sleeves are transparent front and back, others have non-transparent backs in black, yellow or other colors, and still others have pictorial and graphic images on their back panels. Card sleeves with opaque backs obscure the actual back of the game card and thus allow worn cards to be used without being accused of "marking" the card.

Many enthusiastic players of collectible card games invest considerable amounts of money to buy collectible cards and play in tournaments. Accordingly, many players desire to not only protect their cards from wear and tear, but also to personalize or customize the look and appearance of their cards in unique and non-permanent ways.

Further, some collectible cards are manufactured and sold only in certain countries, for example only in Japan, and are not generally available worldwide. Such cards are highly desirable outside the country of origin as they are very unique and very rare. However, such cards cannot be used in games played outside of the country of origin because the text describing their function and rules of play are printed in the language of the country of origin. For example, if the card is intended to be used in Japan, the text on the card would be printed in the Japanese language, and thus could not be used during games played in the United States because the text is not in the English language. As such cards are very collectible, it would be highly desirable to have a card sleeve that would translate the Japanese text to English text, or between any two different languages, without changing the aesthetics of the card, the gameplay mechanics of the card, or the function of the card so they can be played outside their country of origin.

Many cards also have the text of the rules for playing that card printed directly on the card itself. From time to time the rules for playing a particular card are changed. Thus, rather than requiring a player to re-purchase the same card with the updated rules printed thereon, it would be highly desirable to have a card sleeve that would have the text of the updated rules strategically printed thereon so that when a card is loaded within the sleeve, the updated rules text replace the original rules text printed on the card.

SUMMARY OF THE INVENTION

The present invention is an overlay having artwork printed thereon in a strategic location such that when placed over the front face of a card changes the look and appearance of the original artwork on the front face of the card. The overlay may be used with any type of card, but is preferably used with playing cards and trading cards, and is most preferably used with collectible trading cards.

The overlay of the present invention enables a card player, especially a player of a collectible card game, to not only protect a game card but also to personalize or customize the game card. In order to accomplish protection as well as personalization, players can customize their favorite cards in a unique and non-permanent way by printing artwork or any other desired design onto one side of a clear plastic overlay and then partially covering the front face of the playing card or trading card with the overlay. The artwork or design is printed on one side of the clear overlay in a manner and location such that it alters or changes the look and appearance of the front face of the playing card or trading card when the overlay covers the front face of the card, but not its function.

In a first embodiment, the clear overlay with printed artwork or designs strategically located on one side thereof is the front panel or front face of the card sleeve itself. Thus, the artwork or design on the front panel or front face of a plastic card sleeve is positioned in a manner and location that alters or changes the look and appearance of the front face of the playing card or trading card when the playing card or trading card is inserted into the card sleeve. These altered sleeves, with desired custom artwork and design printed on their front panel or face, allow for minor or major aesthetic changes to the look and appearance of the front face of the playing card or trading card, and further enable players to easily change the look and appearance of the playing card or trading card by simply inserting the card into another altered sleeve having different artwork or designs thereon. The altered sleeve may be of the top-loading type, the bottom-loading type, or of the side-loading type, and the artwork or design may be on either or both of its front or rear panels.

In a second embodiment, the clear overlay with artwork or designs strategically located on one side thereon is in the form of a single sheet of thin plastic transparent material, such as polypropylene. The plastic sheet is used by sliding or inserting it between the front face of a playing card or trading card and the front panel or front face of a traditional card sleeve. When positioned properly within a card sleeve, the artwork or design on the plastic sheet covers up portions of the artwork or designs on the front face of the playing card or trading card to alter or change the look and appearance of the card.

In yet a third embodiment, the overlay may be used in a sleeve-in-sleeve arrangement. In other words, the altered sleeve with the artwork or design thereon of the first embodiment may itself be inserted into a separate second sleeve which may be completely transparent or altered to have additional artwork or designs on either or both of its front or rear panels.

The overlay of the present invention thus does not change the functionality of the playing card or trading card. Instead, the overlay merely creates aesthetic changes to the front or rear of playing cards or trading cards. In particular, when playing a collectible card game the overlay enables players to further personalize or customize the look and appearance of their favorite cards in their customized deck of cards.

A method of customizing the look and appearance of cards in accordance with the present invention are also disclosed.

In still other embodiments, the overlay changes the original text printed on the card (1) to provide a translation of that text into any desired language, or (2) to provide updated rule changes from the rules originally printed on the card, or (3) to provide both a translation as well as updated rule changes, if desired.

Thus, one embodiment describes a card sleeve assembly for protecting as well as customizing the look and appearance of a collectible card used in a collectible card game in a non-permanent manner, comprising (a) a collectible card comprising a front face having a graphics section and a textual section, said graphics section including a pictorial design printed thereon, and said textual section including original text printed thereon describing the card's abilities for playing said card in a collectible card game, said pictorial design and original text providing said card with a certain tactical and functional value when playing said card in a collectible card game; (b) a card sleeve comprising a front panel corresponding dimensionally with the front face of said collectible card, and said front panel having a transparent portion corresponding dimensionally to the graphics section of said collectible card, and an opaque portion corresponding dimensionally to the textual section of said collectible card, said opaque portion including new text printed therein which changes the original text printed in the textural section of said card, said front panel including opposite side edges, a bottom edge, and a top edge; a back panel having opposite side edges, a bottom edge, and a top edge; and a plurality of seams attaching the edges of said front and back panels in such a manner so as to define an interior for slidably receiving the collectible card therein; and (c) wherein the opaque portion containing the new text is printed on the front panel of said card sleeve at a strategic location thereon such that it coincides with and overlays the textural section of the collectible card and thereby changes the original text printed in the textural section of the front face of the collectible card, but does not alter the pictorial design printed on the graphics section of the front face of the collectible card, when the collectible card is inserted and received within the card sleeve so that the front panel of the card sleeve covers the front face of the collectible card.

Another embodiment describes a card sleeve assembly for protecting as well as customizing the look and appearance of a collectible card used in a collectible card game in a non-permanent manner, comprising (a) a collectible card comprising a front face having a graphics section and a textual section, said graphics section including a pictorial design printed thereon, and said textual section including original text printed thereon describing the card's abilities for playing said card in a collectible card game, said pictorial design and original text providing said card with a certain tactical and functional value when playing said card in a collectible card game; (b) an outer sleeve member comprising (1) a transparent front panel having opposite side edges, a bottom edge, and a top edge; (2) a rear panel having opposite side edges, a bottom edge, and a top edge; and (3) a plurality of seams attaching the edges of said front and rear panels in such a manner so as to define an interior therein; (c) an inner sleeve member disposed in the interior of said outer sleeve member, said inner sleeve member comprising a front panel corresponding dimensionally with the front face of said collectible card, and said front panel having a transparent portion corresponding dimensionally to the graphics section of said collectible card, and an opaque portion corresponding dimensionally to the textual section of said collectible card, said opaque portion including new text printed therein which changes the original text printed in the textural section of said card, said front panel including opposite side edges, a bottom edge, and a top edge; a back panel having opposite side edges, a bottom edge, and a top edge; and a plurality of seams attaching the edges of said front and back panels in such a manner so as to define an interior for slidably receiving the collectible card therein; and (d) wherein the opaque portion containing the new text is printed on the front panel of said card sleeve at a strategic location thereon such that it coincides with and overlays the textural section of the collectible card and thereby changes the original text printed in the textural section of the front face of the collectible card, but does not alter the pictorial design printed on the graphics section of the front face of the collectible card, when the collectible card is inserted and received within the card sleeve so that the front panel of the card sleeve covers the front face of the collectible card.

In some embodiments, the original text of said textural section of said collectible card is in a first language, and the new text in the opaque portion of the front panel of the card sleeve comprises a translation of said first language into a different second language.

In some embodiments, said collectible card includes original card title text located above said graphics section printed in said first language, and said card sleeve includes new title text printed on the front panel of said card sleeve at a strategic location thereon such that it coincides with and overlays the original title text of the collectible card, said new title text comprises a translation of said first language into a different second language.

In some embodiments, said collectible card includes original card type text located below said upper graphics section, said card type text printed in said first language, and said card sleeve includes new card type text printed on the front panel of said card sleeve at a strategic location thereon such that it coincides with and overlays the original card type text of the collectible card, said new card type text comprises a translation of said first language into a different second language.

In some embodiments, said first language comprises Japanese and said second language comprises English. In other embodiments, said first language comprises English and said second language comprises Japanese.

In some embodiments, the original text of said textural section of said collectible card includes original rules for playing said card in a collectible card game, and the new text in the opaque portion of the front panel of the card sleeve comprises updated rules for playing said card in a collectible card game.

In some embodiments, the original rules are printed in a first language, and the updated rules are printed in a different second language comprising a translation of said original rules.

DETAILED DESCRIPTION OF THE INVENTION

Figure 1:
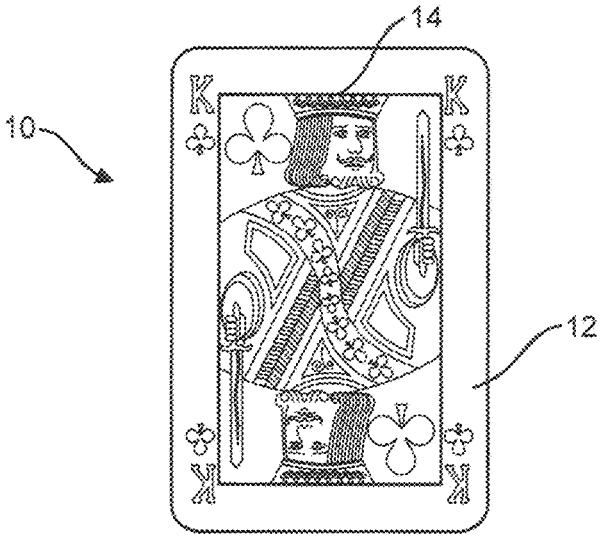
FIG. 1 is a front plan view of a generic playing card illustrating the front face of the king of clubs.

The present invention will now be described with reference to an exemplary card, namely, the king of clubs playing card 10 illustrated in FIG. 1. Those skilled in the art, however, will recognize the present invention is applicable with any type of card such as, but not limited to, (1) any of the fifty two conventional cards in a deck of playing cards used in playing card games such as poker, bridge, euchre, hearts, sheepshead, Uno and other recreational card games; (2) any of the typical trading cards, especially sports trading cards relating to baseball, football, basketball, hockey and other sports; (3) collectible trading cards such as, for example, those used in the game "Magic: The Gathering"; (4) credit cards or debit cards; (5) greeting cards; and (6) other types of cards a person might desire to protect and personalize. Such cards are typically rectangular in shape measuring about 3.5 inches by 2.5 inches, and are composed of a piece of relatively thick, stiff paper such as cardboard or pasteboard, or of a thin plastic sheet material like polypropylene, having printed artwork, graphics or text thereon. Such cards may also have different shapes and dimensions depending on its function. Preferably the present invention is designed for use with trading cards, and most preferably for use with collectible trading cards.

The term "artwork" is meant to be broadly interpreted to mean any designs, pictorial works, graphics, or textual matter in any shape or form. The artwork may be black and white or it may be of the same or multiple different colors.

The king of clubs playing card 10 has a front face 12 imprinted with a standard design found upon each of the cards in a set of playing cards which in the present example of card 10 is the bust of a king having a jeweled crown 14. The card 10 also has a back face 16 imprinted with a generic geometric pattern (not shown) such as diamonds, hearts, flowers, and the like, as is traditional and well known.

Figure 2:
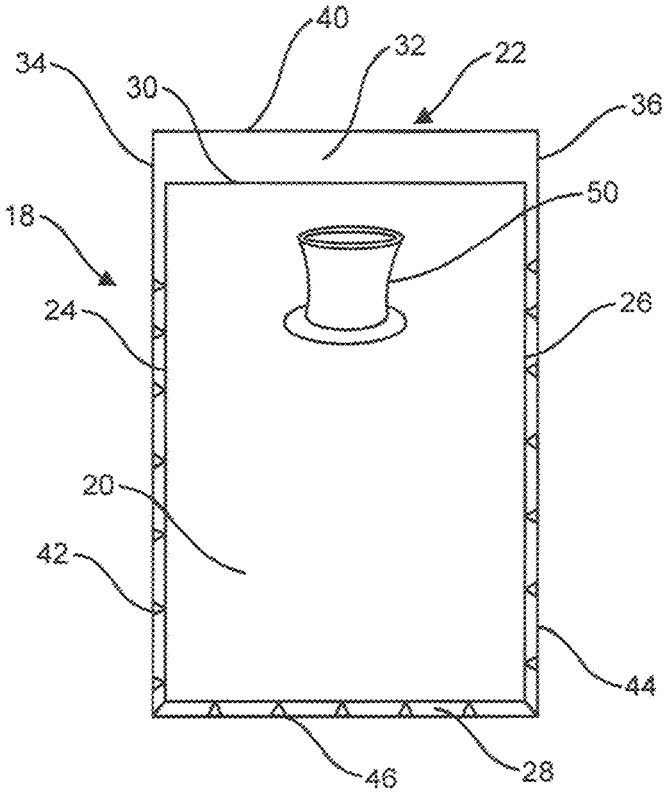
FIG. 2 is a front plan view illustrating a first embodiment of the overlay of the present invention as being the front panel of a transparent card sleeve altered by having artwork in the form of a top hat printed thereon.
Figure 3:
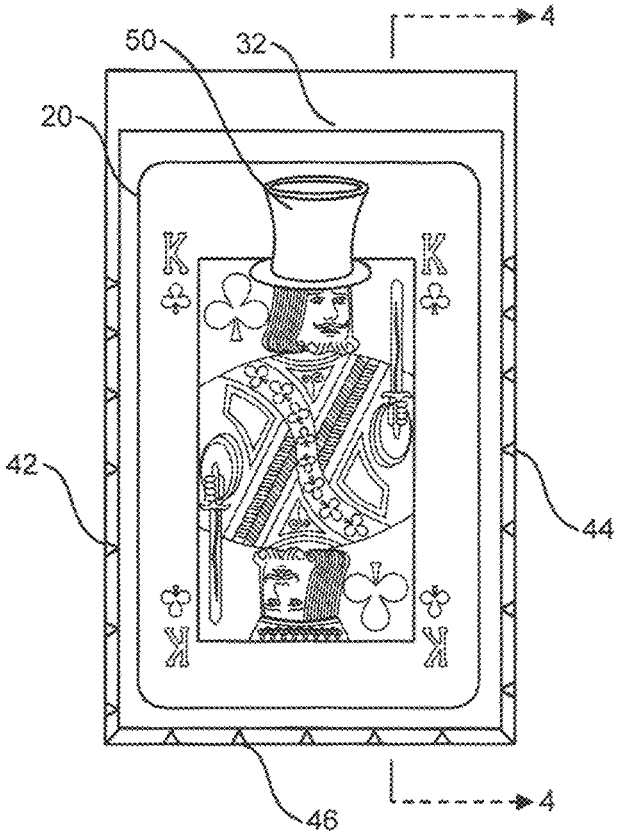
FIG. 3 is a front plan view illustrating the king of clubs playing card of FIG. 1 inserted into the altered card sleeve of FIG. 2 to provide a customized look and appearance to the king of clubs playing card.
Figure 4:
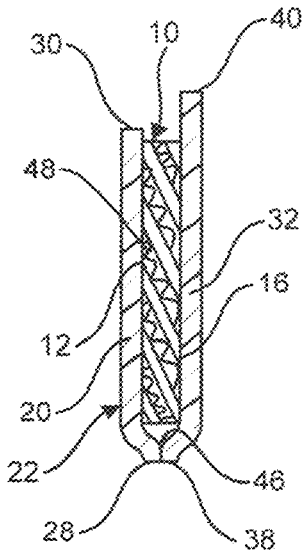
FIG. 4 is an enlarged sectional view taken through the line 4-4 in FIG. 3.

FIG. 2 illustrates an overlay 18 in accordance with a first embodiment of the present invention. Overlay 18 comprises front panel 20 of a conventional card sleeve 22 made of a transparent plastic material such as polypropylene. Card sleeve 22 includes a pair of sleeve panels, namely, front panel 20 and back panel 32. As illustrated in FIGS. 3 and 4, front panel 20 has a pair of opposite side edges 24 and 26, a bottom edge 28, and a top edge 30. Likewise, back panel 32 has a pair of corresponding side edges 34 and 36, bottom edge 38, and top edge 40. A plurality of panel seams 42, 44 and 46 attach front panel 20 to back panel 32 to define a sleeve interior 48 between front panel 20 and back panel 32 which has the approximate dimensions (3.5 inches by 2.5 inches) of a standard size playing card such as the king of clubs 10 so as to snuggly receive card 10 therein. Panel seams 42, 44 and 46 may be heat seals or mechanical seals, and as illustrated, seam 42 attaches the edge margins of side edges 24 and 34, seam 44 attaches the edge margins of side edges 26 and 36, and seam 46 attaches the edge margins of bottom edges 28 and 38 so as to leave the top edges 30 and 40 unattached to provide an opening or slot for permitting card 10 to be slid into the sleeve interior 48 with its front face 12 toward front panel 20, as shown in FIG. 3. It should also be noted that side edges 24 and 34, as well as side edges 26 and 36 may be integrally formed in a seamless manner depending upon the manufacturing process used to make sleeve 22.

FIG. 2 illustrates front panel 20 of card sleeve 22 has artwork in the form of a top hat 50 imprinted thereon. Top hat 50 is disposed on front panel 20 at a location such that when card 10 is received within the interior 48 of card sleeve 22, top hat 50 covers the jeweled crown 14 of the king illustrated in the king of clubs card 10. Thus, as illustrated in FIG. 3, the aesthetic appearance of the front face 12 of card 10 changes from the king having the jeweled crown 14 to one where the king now has the top hat 50.

As one skilled in the art will recognize, the change from jeweled crown 14 to top hat 50 is only exemplary. Other artwork could be imprinted on the front panel 20 of card sleeve 22, and at different locations, to change or modify other aspects of card 10 resulting in a personalized or customized appearance for card 10 when it is inserted into card sleeve 22.

Figure 5:
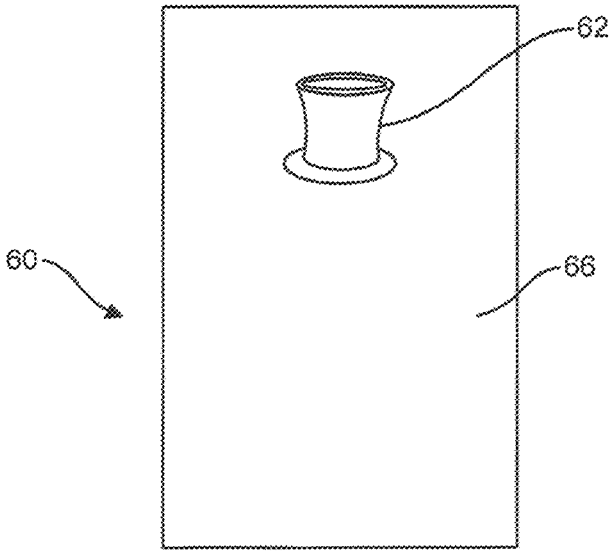
FIG. 5 is a front plan view illustrating a second embodiment of the overlay of the present invention as being a single sheet of thin plastic transparent material altered by having artwork in the form of a top hat printed thereon.
Figure 6:
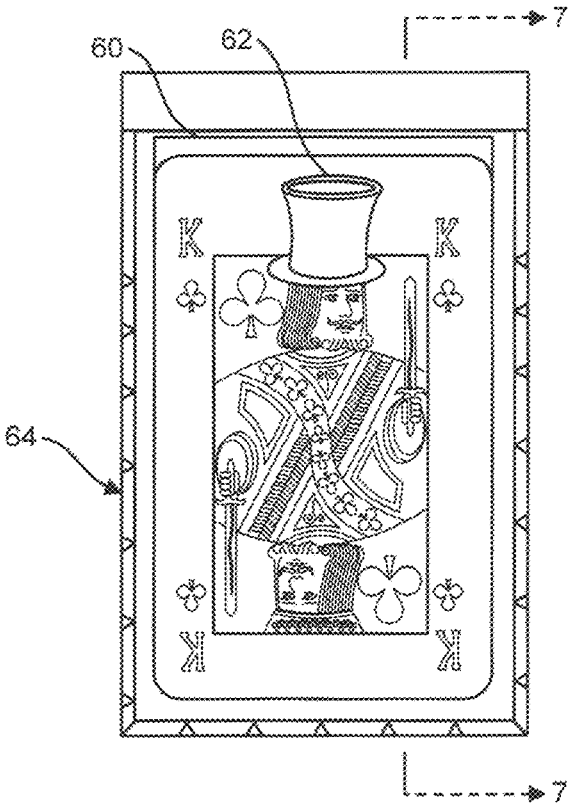
FIG. 6 is a plan view illustrating the king of clubs playing card of FIG. 1 inserted into a standard transparent card sleeve and the single sheet overlay of FIG. 5 inserted into the card sleeve between the front face of the king of clubs and the front panel of the card sleeve to provide a customized look and appearance to the king of clubs playing card.
Figure 7:
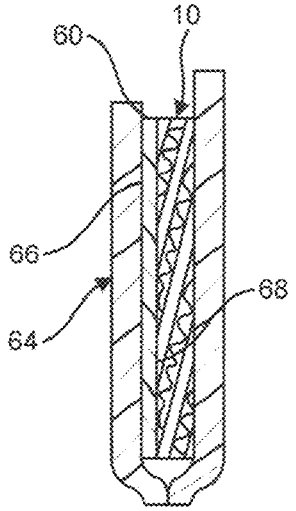
FIG. 7 is an enlarged sectional view taken through the line 7-7 in FIG. 6.

Referring now to FIGS. 5-7, there is illustrated an overlay 60 in accordance with a second embodiment of the present invention. Overlay 60 comprises a single sheet of thin plastic transparent material, such as polypropylene, having artwork in the form of a top hat 62 printed on one side thereof. Overlay 60 has the approximate dimensions (3.5 inches by 2.5 inches) of a standard size playing card such as the king of clubs 10. Top hat 62 is strategically located on overlay 60 so that in use it will cover the jeweled crown 14 of the king of clubs playing card 10 shown in FIG. 1, as will hereinafter be described.

Overlay 60 will typically be used with a conventional card sleeve 64. Card sleeve 64 is constructed in the same manner as card sleeve 22 previously described herein with a front panel 66 attached at its peripheral outer edges to a back panel 68. However, in this embodiment, front panel 66 is preferably completely transparent with no artwork printed thereon.

Overlay 60 is used by sliding or inserting it between front face 12 of the king of clubs playing card 10 and the front panel 66 of card sleeve 64. When positioned properly within card sleeve 64, the top hat 62 of overlay 60 covers up the jeweled crown 14 of the king of clubs 10 to alter or change the look and appearance of the king depicted in the king of clubs playing card 10. Thus, the aesthetic appearance of the front face 12 of the card 10 changes from the king having the jeweled crown 14 to one where the king now haws the top hat 62.

As one skilled in the art will recognize, the change from jeweled crown 14 to top hat 62 is only exemplary. Other artwork could be imprinted on the front panel 66 of card sleeve 64, and at different locations, to change or modify other aspects of card 10 resulting in a personalized or customized appearance for card 10 when it is inserted into card sleeve 64.

Figure 8:
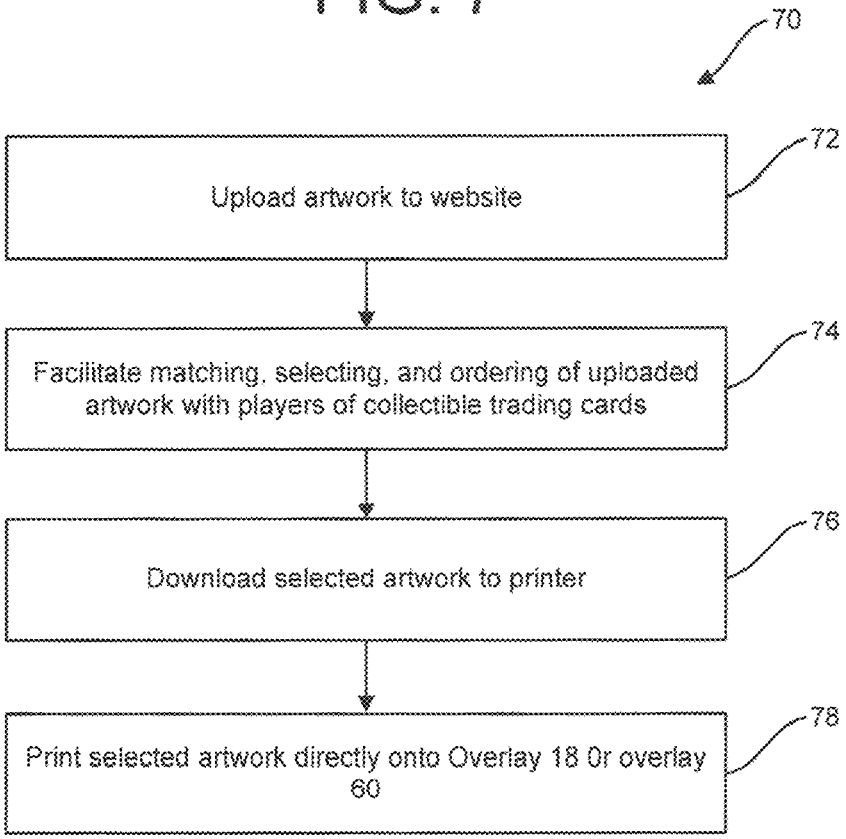
FIG. 8 is a schematic flow diagram of a method of customizing the look and appearance of playing cards and trading cards in accordance with the present invention.

Referring next to FIG. 8 of the drawings, a flow diagram 70 of an exemplary embodiment of an overlay printing method is illustrated. In block 72, artwork designed and created by an artist is uploaded to a website. In block 74, the web-based platform facilitates the matching, selecting, and ordering of one or more of the uploaded artworks with a player who has accessed the website and who desires to personalize or customize collectible trading cards. In block 76, the selected artwork is downloaded to a printer. In block 78, the selected artwork is printed directly onto either overlay 18 or overlay 60.

Figure 9:
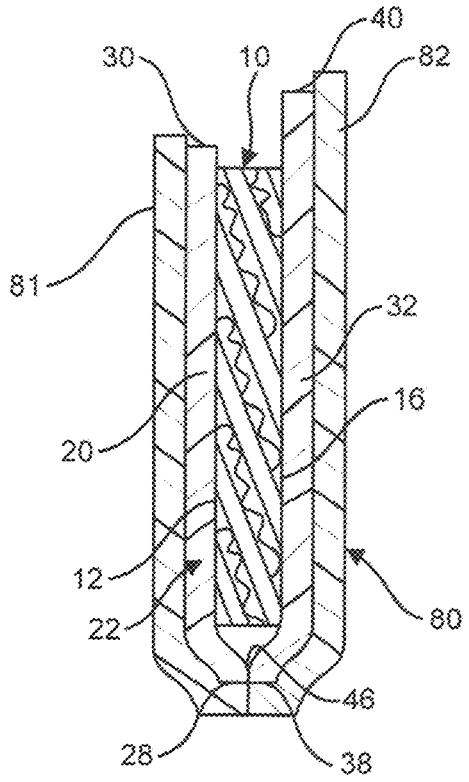
FIG. 9 is an enlarged sectional view similar to FIG. 4 illustrating a third embodiment of the overlay of the present invention as being a sleeve-in-sleeve arrangement where the altered sleeve of FIG. 4 is inserted into a second card sleeve.

Referring now to FIG. 9, there is illustrated a third embodiment where the overlay 18 is used in a sleeve-in-sleeve arrangement. In other words, a first sleeve member comprising the altered sleeve 22 with the artwork or design thereon of the first embodiment may itself be inserted into a separate second sleeve member comprising a second card sleeve 80 for additional protection or customization. Card sleeve 80 may be completely transparent or altered to have additional artwork or designs on either or both of its front panel 81 or rear panel 82. Card sleeve 80 is constructed in the same manner as card sleeve 22 previously described herein with its front panel 81 attached at its peripheral outer edges to its rear panel 82 leaving an open top for slidably receiving the altered card sleeve 22. In this embodiment, front panel 81 of card sleeve 80 is preferably completely transparent with no artwork printed thereon so that the artwork printed on the front panel 20 of altered sleeve 22 may be seen. However, in other embodiments, card sleeve 80 may itself have artwork or designs printed on either or both of panels 81 and 82 to enable additional customization, if desired.

Figure 10:
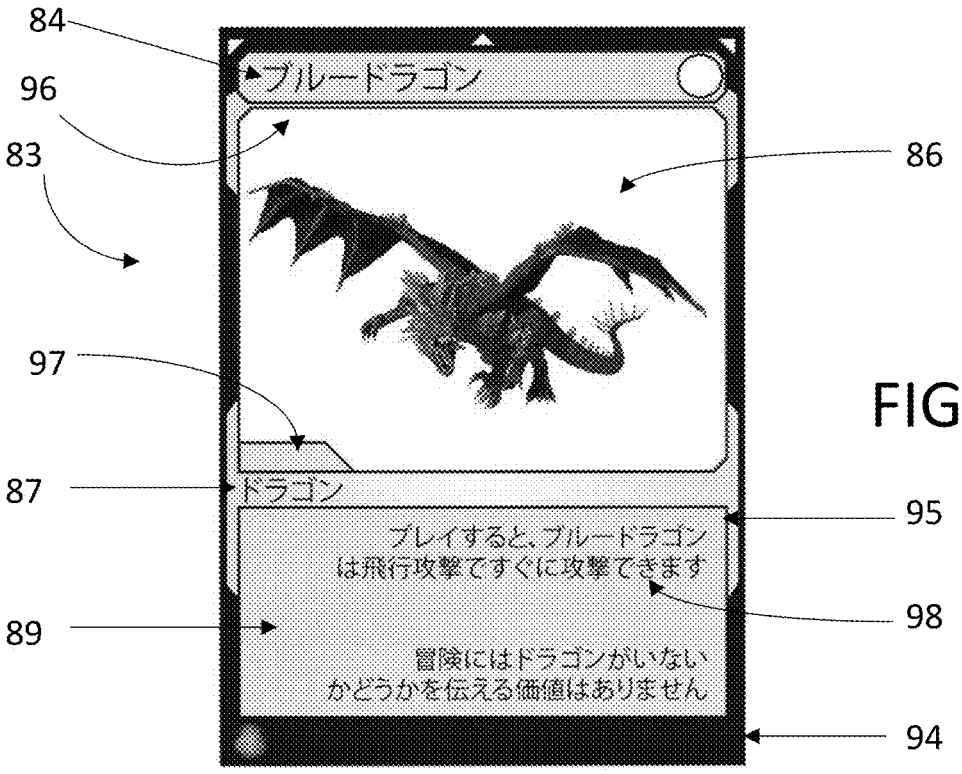
FIG. 10 is a front plan view of a playing card having text printed in the Japanese language describing the gameplay function of the card.

Referring now to FIG. 10, there is illustrated a typical playing card 83 used in a collectible card game The card 83 contains information specific to gameplay for the collectible card game, and is formatted in such a manner so that all cards used in gameplay for the collectible card game have similar information always located in the same place on the face of each card. Thus, as illustrated in FIG. 10, card 83 has an elongated card title box or title bar 84 located at its top edge margin which usually contains a single-line of text printed on an opaque background describing the name or title of the card 83. Different cards used in gameplay have different names, but each card has a name that serves as its unique identifier which is printed in box 84.

Card 83 includes unique artwork 86 located just below the title box 84. A dragon is illustrated as the artwork 86 in the upper section of card 83. Different cards used in gameplay have different artwork, but each card will have its own unique original artwork which typically will correspond to the name or title found in box 84. The artwork will typically illustrate or depict fantasy or science fiction genres, horror themes, cartoons, aliens, and the like. An elongated card type box or bar 87 is located below the artwork 86 on card 83. Box 87 may contain a single-line of text printed on an opaque background that corresponds dimensionally to the area of box 87, and that text typically describes the pictorial artwork 86.

Located below the card type box 87 is a card abilities box 89, sometimes referred to as a text box, which is defined by a substantially rectangular peripheral line 95 and is divided into an upper section and a lower section. The upper section of box 89 usually contains multiple lines of text describing information about what the card actually does in the game, i.e. its abilities when played, as well as rules for playing the card during gameplay. The lower section of box 89 usually contains italicized text that tells a little snippet or story about the card and how it fits into the game. Both the upper text and the lower text are typically printed within peripheral line 95 on an opaque background that corresponds dimensionally to the area of abilities box 89.

Card 83 also has a border 94 defining top, bottom, left side and right side edge margins used to frame the card title box 84, the card type box 87, the card abilities box 89, and the artwork 86. The border 94 is usually black in color, but may be any desired color depending on, for example, the colors used in artwork 86 of card 83.

Referring to FIG. 10, playing card 83 is illustrated as having text printed in the Japanese language thereon. The Japanese text 96 is located within card title box 84 of card 83 above the artwork 86 of a dragon, and names the card. The Japanese text 97 is located within the card type box 87 of card 83 below the dragon artwork 85, and identifies the card type. The Japanese text 98 is printed within card abilities box 89 of card 83 beneath the box 87, and describes the gameplay function of the card 83, i.e. its abilities and the rules for playing the card.

Figure 11:
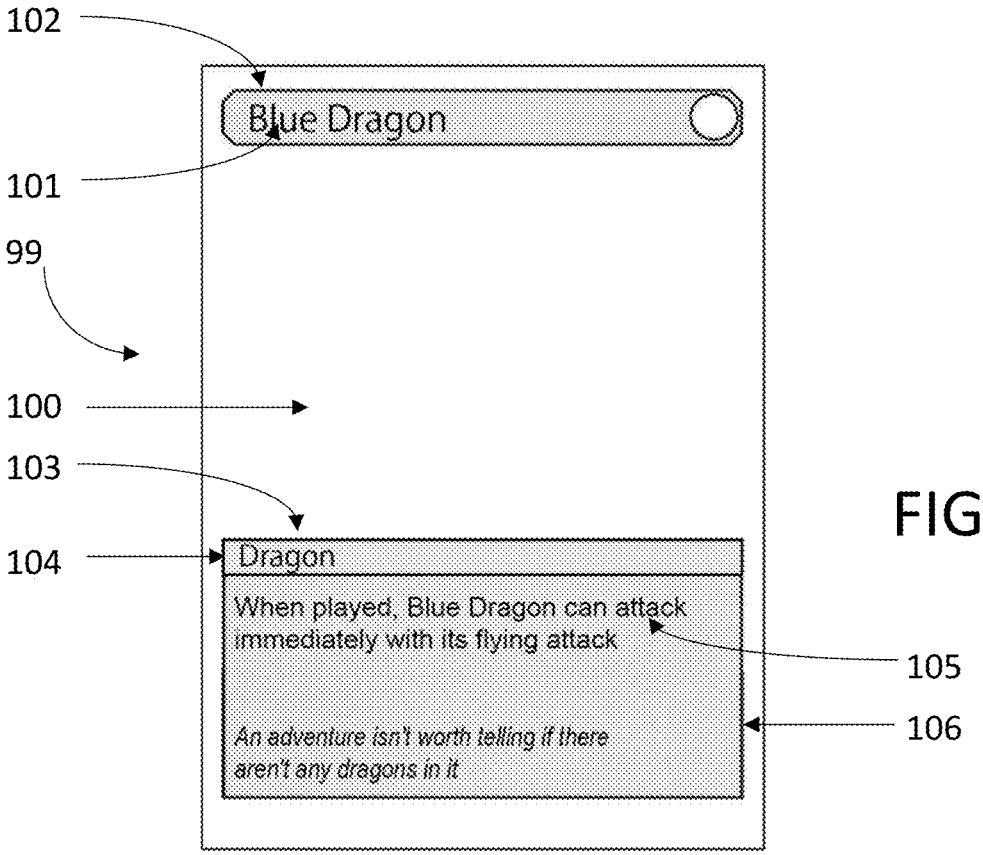
FIG. 11 is a front plan view of a card sleeve having the Japanese gameplay text of the card of FIG. 10 translated into English.

FIG. 11 illustrates a card sleeve 99, which is constructed in the same manner as card sleeve 22 previously described herein, having its front panel 100 with artwork in the form of English language text printed thereon at strategic locations to coincide with the artwork printed on card 83. English language text 101 is a literal translation of the Japanese text 96 in box 84 of card 83, and is printed against an opaque white background within an elongated title box or bar 102 located at the upper end or top of front panel 100 of sleeve 99. English language text 103 is a literal translation of the Japanese text 97 of card 83, and is printed against an opaque white background within an elongated card type box 104 located approximately at the middle of front panel 100 of card sleeve 99. English language text 105 is a literal translation of the Japanese text 98 of card 83, and is printed against an opaque white background within a card abilities box 106 at the lower portion of front panel 100 of sleeve 99. The locations and layout of the English language texts 101, 103 and 105 on front panel 100 of sleeve 99 correspond with the locations and layout of the Japanese texts 96, 97 and 98, respectively, on card 83, and are strategically positioned on the front panel 100 of sleeve 99 at identical locations to that of title box 84, type box 87 and abilities box 89 of card 83 such that when card 83 is received and loaded within the interior of card sleeve 99, the English language texts 101, 103 and 105 overlay and completely cover the Japanese texts 96, 97 and 98, respectively, of original card 83. In other words, the original Japanese language printed on card 83 is no longer visible to a user of card 83. Only the English language translations are visible.

Figure 12:
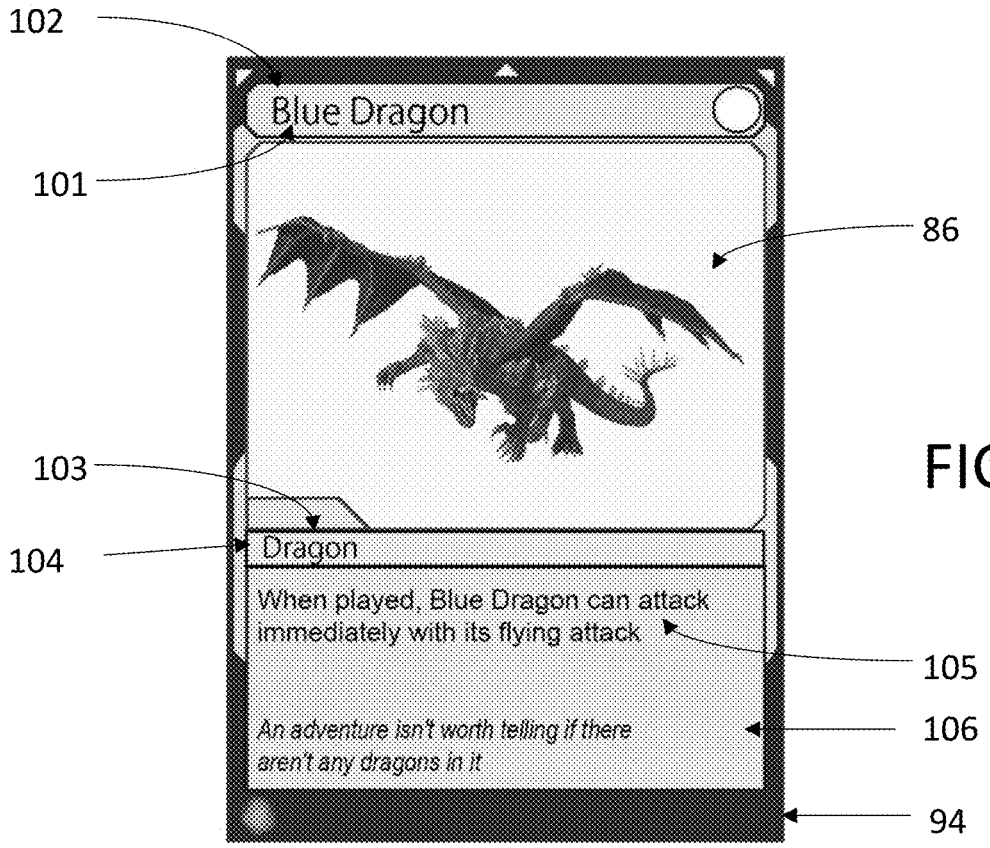
FIG. 12 is a front plan view of the playing card of FIG. 10 inserted into the card sleeve of FIG. 11 to provide a customized playing card with English gameplay text.

As shown in FIG. 12, which illustrates playing card 83 loaded into and received within sleeve 99, all of the Japanese texts 96, 97 and 98 on the front face of original card 83 have been translated and thus changed from the original Japanese language to the English language, but the artwork 86, gameplay mechanics and functionality of card 83 have not been changed. In other words, although the original Japanese language printed on card 83 has been translated into the English language, the artwork 86 and any other element on card 83 that is not relevant to gameplay have not been changed. Only the relevant elements of card 83 that have a gameplay effect, such as the name, card type and abilities text, have been changed or translated from the original printed language. As a result, the playing card 83, which was originally only available for play in Japan, is now available for play in any English language speaking country with the same functionality as was originally intended for card 83.

It should be noted that although FIGS. 10-12 illustrate the use of sleeve 99 to translate the original Japanese language text to English language text, the sleeve 99 may be used to provide translations between any two languages. For example, the original Japanese text could be translated into French, German, Korean, Danish, or any other language, in addition to English. Likewise, if the original text was in English, sleeve 99 may be used to translate the original English text into Japanese, Korean, French, German, Danish, or any other language. Thus, the original language of the text printed on a playing card can be translated into any other desired language by the use of a card sleeve as illustrated and described herein.

Figure 13:
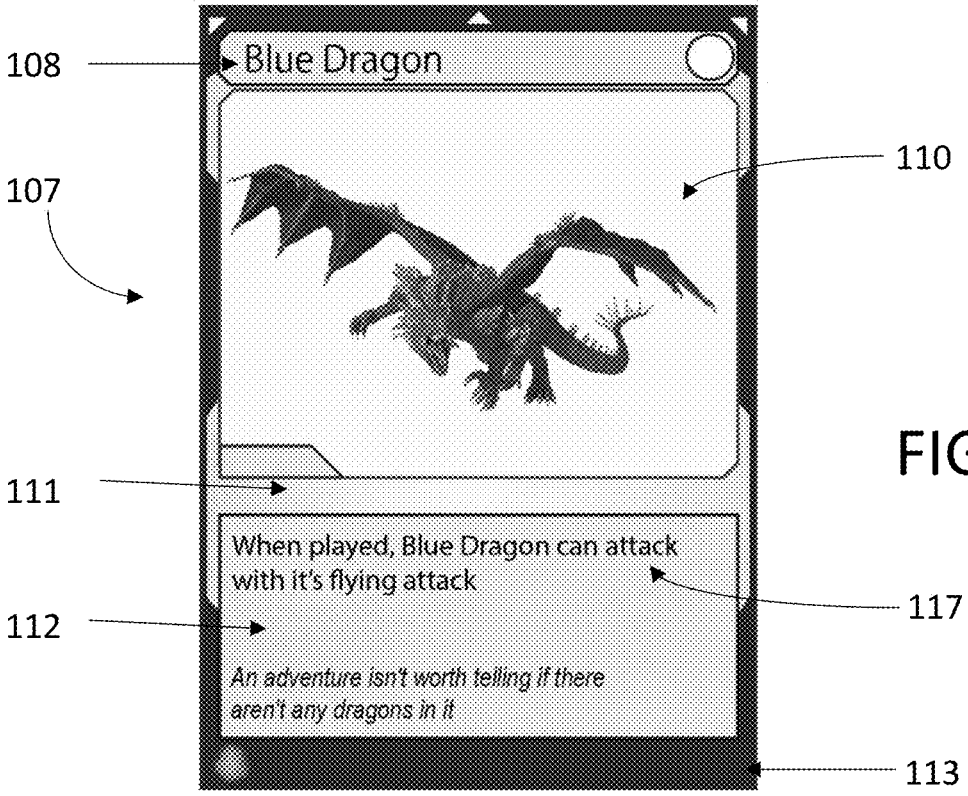
FIG. 13 is a front plan view of a playing card having text printed thereon describing the rules for playing the card.

Turning now to FIG. 13, there is illustrated a playing card 107 having its various components formatted so that they are located in the identical positions on the face of card 107 as that described with respect to card 83 of FIGS. 10-12. Thus, card 107 has an elongated title box 108 located along and adjacent to its upper edge, artwork 110 directly below title box 108, a card type box 111 beneath the artwork 110, and a card abilities box 112 directly below the card type box 111. Card 107 also has a border 113 surrounding boxes 108, 111 and 112 as well as artwork 110. Text 117 printed on an opaque background within the abilities box 112 of card 107 describes the specific original rules for playing card 107. The text 117 is illustrated to be printed in the English language, but as described previously herein, may be printed in any desired language.

From time to time the rules for playing a particular card in a collectible card game are changed. Thus, rather than requiring a player to re-purchase the same card with the changed or updated rules printed thereon, a card sleeve 118, such as that illustrated in FIG. 14, may be used to update the new rules for playing card 107. Sleeve 118 has the text 119 of the changed or updated rules strategically printed thereon over an opaque background so that when the card 107 is loaded within the sleeve 118, the updated rules text 119 overlays, covers and replaces the original rules text 117 that was printed within the abilities box 112 of the card 107.

Figure 14:
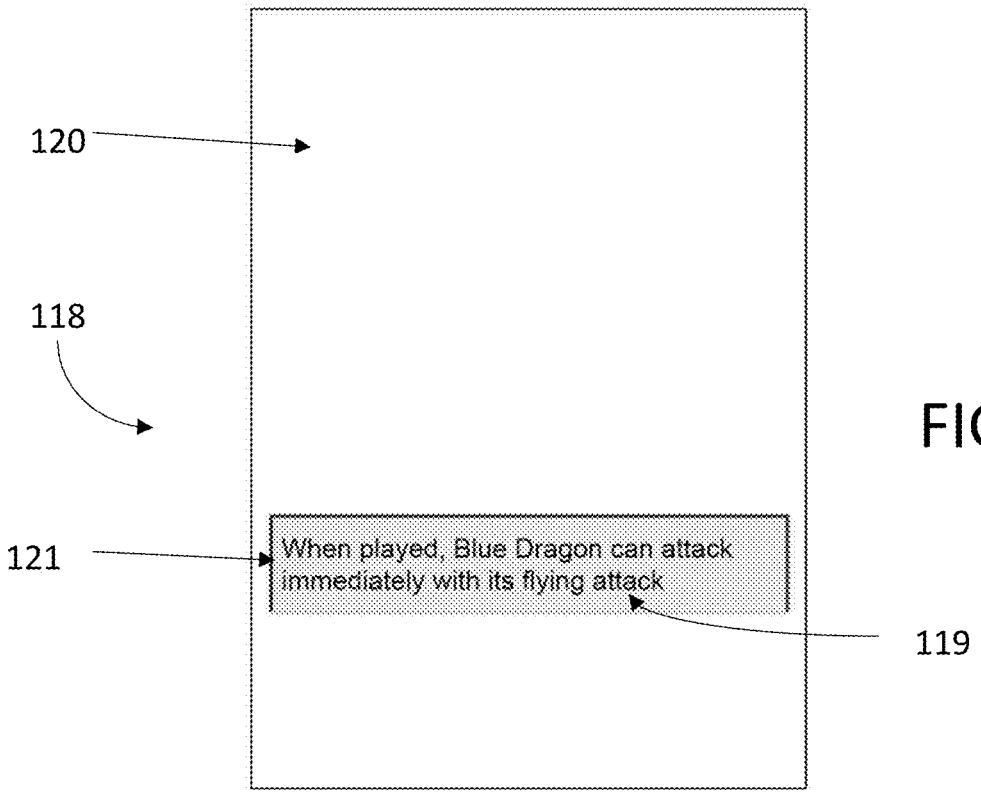
FIG. 14 is a front plan view of a card sleeve having the text of the updated rules for the card of FIG. 13.

FIG. 14 illustrates card sleeve 118, which is constructed in the same manner as card sleeves 22 and 99 previously described herein, having a transparent front panel 120, except for an abilities box 121 containing the new rules text 119 printed therein on an opaque background. The location and dimensions of the abilities box 121 and text 119 describing the updated new rules for playing card 107 on the front panel 120 of sleeve 118 correspond exactly with the location of the abilities box 112 and text 117 describing the original rules on card 107, and is strategically positioned on the front panel 120 of sleeve 118 at a location such that when card 107 is loaded into and received within the interior of card sleeve 118, the abilities box 121 and updated new rules text 119 overlay and completely cover the abilities box 112 and text 117 describing the original rules for playing card 107. Again, it should be noted that although the texts 117 and 119 are illustrated in FIGS. 13-15 in the English language, the texts 117 and 119 may be in any desired language.

Figure 15:
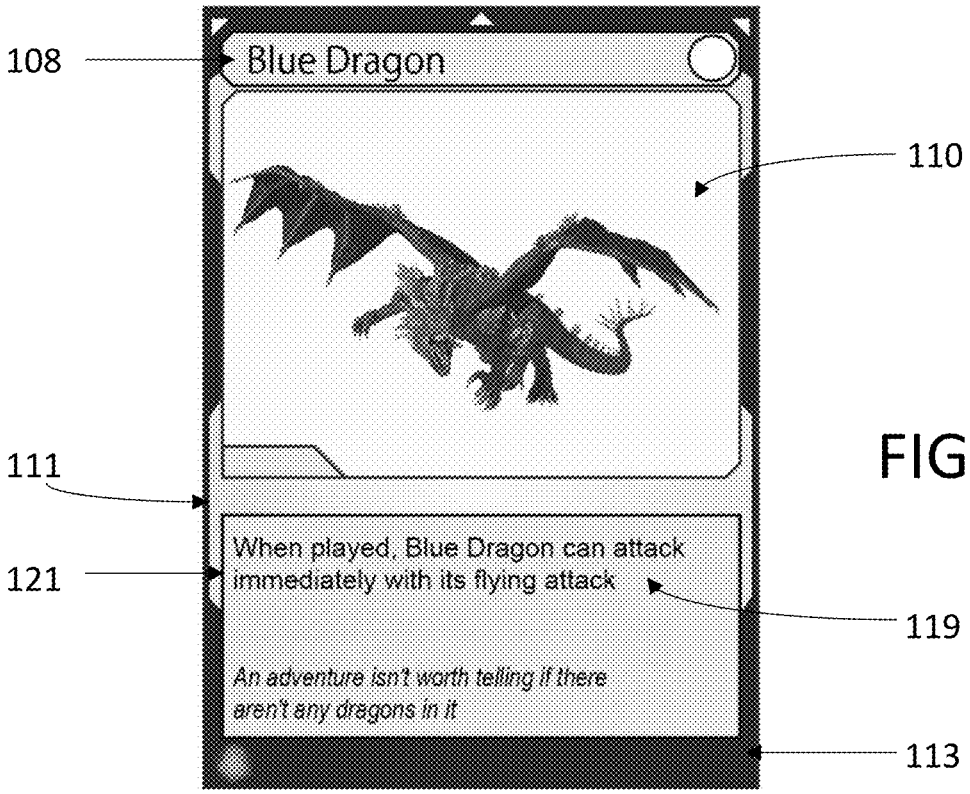
FIG. 15 is a front plan view of the playing card of FIG. 13 inserted into the card sleeve of FIG. 14 illustrating a customized playing card with the updated rules.

As shown in FIG. 15, which illustrates playing card 107 loaded into and received within sleeve 118, all of the original rules text 117 within abilities box 112 on the front face of card 107 have thus been changed from the original rule text 117 to the updated new rules text 119. It should also be noted, however, that the title box 108 and text therein, the artwork 110, the card type box 111 and text therein, the boarder 113, and any other gameplay elements of card 107 remain unchanged. Only the text within the abilities box 112 has been changed when card 107 is loaded within sleeve 118. As a result, the playing card 107 may now be played during a game as it was originally intended, but in accordance with the updated new rules.

I claim:

1. A card sleeve assembly for protecting as well as customizing the look and appearance of a collectible card used in a collectible card game in a non-permanent manner, comprising: a collectible card comprising a front face having a graphics section and a textual section, said graphics section including a pictorial design printed thereon, and said textual section including original gameplay text printed thereon describing the card's abilities for playing said card in a collectible card game, said pictorial design and original gameplay text providing said card with a certain tactical and functional value when playing said card in a collectible card game; a card sleeve comprising a front panel corresponding dimensionally with the front face of said collectible card, and said front panel having a transparent portion corresponding dimensionally to the graphics section of said collectible card, and an opaque portion corresponding dimensionally to the textual section of said collectible card, said opaque portion including new text printed therein which changes observable text from a front view of the card sleeve from the original text printed in the textural section of said card, said front panel including opposite side edges, a bottom edge, and a top edge; a back panel having opposite side edges, a bottom edge, and a top edge; and a plurality of seams attaching the edges of said front and back panels in such a manner so as to define an interior for slidably receiving the collectible card therein; and wherein the opaque portion containing the new text is printed on the front panel of said card sleeve at a strategic location thereon such that it coincides with and overlays the textural section of the collectible card and thereby changes observable text from the front view of the card sleeve from the original text printed in the textural section of the front face of the collectible card, but does not alter the pictorial design printed on the graphics section of the front face of the collectible card, when the collectible card is inserted and received within the card sleeve so that the front panel of the card sleeve covers the front face of the collectible card.

2. The card sleeve assembly of claim 1 wherein the original text of said textural section of said collectible card is in a first language, and the new text in the opaque portion of the front panel of the card sleeve comprises a translation of said first language into a different second language.

3. The card sleeve assembly of claim 2 wherein said collectible card includes original card title text located above said graphics section printed in said first language, and said card sleeve includes new title text printed on the front panel of said card sleeve at a strategic location thereon such that it coincides with and overlays the original title text of the collectible card, said new title text comprises a translation of said first language into a different second language.

4. The card sleeve assembly of claim 2 wherein said collectible card includes original card type text located below said graphics section, said card type text printed in said first language, and said card sleeve includes new card type text printed on the front panel of said card sleeve at a strategic location thereon such that it coincides with and overlays the original card type text of the collectible card, said new card type text comprises a translation of said first language into a different second language.

5. The card sleeve assembly of claim 2 wherein said first language comprises Japanese and said second language comprises English.

6. The card sleeve assembly of claim 2 wherein said first language comprises English and said second language comprises Japanese.

7. The card sleeve assembly of claim 1 wherein the original text of said textural section of said collectible card includes original rules for playing said card in a collectible card game, and the new text in the opaque portion of the front panel of the card sleeve comprises updated rules for playing said card in a collectible card game.

8. The card sleeve assembly of claim 7 wherein the original rules are printed in a first language, and the updated rules are printed in a different second language comprising a translation of said original rules.

9. A card sleeve assembly for protecting as well as customizing the look and appearance of a collectible card used in a collectible card game in a non-permanent manner, comprising: a collectible card comprising a front face having a graphics section and a textual section, said graphics section including a pictorial design printed thereon, and said textual section including original gameplay text printed thereon describing the card's abilities for playing said card in a collectible card game, said pictorial design and original gameplay text providing said card with a certain tactical and functional value when playing said card in a collectible card game; an outer sleeve member comprising (a) a transparent front panel having opposite side edges, a bottom edge, and a top edge; (b) a rear panel having opposite side edges, a bottom edge, and a top edge; and (c) a plurality of seams attaching the edges of said front and rear panels in such a manner so as to define an interior therein; an inner sleeve member disposed in the interior of said outer sleeve member, said inner sleeve member comprising a front panel corresponding dimensionally with the front face of said collectible card, and said front panel having a transparent portion corresponding dimensionally to the graphics section of said collectible card, and an opaque portion corresponding dimensionally to the textual section of said collectible card, said opaque portion including new text printed therein which changes observable text from a front view of the card sleeve from the original text printed in the textural section of said card, said front panel including opposite side edges, a bottom edge, and a top edge; a back panel having opposite side edges, a bottom edge, and a top edge; and a plurality of seams attaching the edges of said front and back panels in such a manner so as to define an interior for slidably receiving the collectible card therein; and wherein the opaque portion containing the new text is printed on the front panel of said card sleeve at a strategic location thereon such that it coincides with and overlays the textural section of the collectible card and thereby changes observable text from the front view of the card sleeve from the original text printed in the textural section of the front face of the collectible card, but does not alter the pictorial design printed on the graphics section of the front face of the collectible card, when the collectible card is inserted and received within the card sleeve so that the front panel of the card sleeve covers the front face of the collectible card.

10. The card sleeve assembly of claim 9 wherein the original text of said textural section of said collectible card is in a first language, and the new text in the opaque portion of the front panel of the card sleeve comprises a translation of said first language into a different second language.

11. The card sleeve assembly of claim 9 wherein said collectible card includes original card title text located above said upper graphics section printed in said first language, and said card sleeve includes new title text printed on the front panel of said card sleeve at a strategic location thereon such that it coincides with and overlays the original title text of the collectible card, said new title text comprises a translation of said first language into a different second language.

12. The card sleeve assembly of claim 9 wherein said collectible card includes original card type text located below said graphics section, said card type text printed in said first language, and said card sleeve includes new card type text printed on the front panel of said card sleeve at a strategic location thereon such that it coincides with and overlays the original card type text of the collectible card, said new card type text comprises a translation of said first language into a different second language.

13. The card sleeve assembly of claim 10 wherein said first language comprises Japanese and said second language comprises English.

14. The card sleeve assembly of claim 10 wherein said first language comprises English and said second language comprises Japanese.

15. The card sleeve assembly of claim 9 wherein the original text of said textural section of said collectible card includes original rules for playing said card in a collectible card game, and the new text in the opaque portion of the front panel of the card sleeve comprises updated rules for playing said card in a collectible card game.

16. The card sleeve assembly of claim 15 wherein the original rules are printed in a first language, and the updated rules are printed in a different second language comprising a translation of said original rules.

* * * * *